United States Patent [19]

Maxwell et al.

[11] Patent Number: 4,825,780

[45] Date of Patent: May 2, 1989

[54] BILEVEL STUDENT ACTIVITY TABLE

[76] Inventors: Ronald M. Maxwell, 6339 Horn Rd., Lake Leelanaw, Mich. 45693; Arthur W. Carlson, 980 Ada Ave., Muskegon, Mich. 49442

[21] Appl. No.: 108,229

[22] Filed: Oct. 14, 1987

[51] Int. Cl.[4] ..... A47F 5/12

[52] U.S. Cl. ..... 108/144; 108/145

[58] Field of Search ..... 108/144, 146, 147, 112, 108/113; 248/231.7, 421, 595

[56] References Cited

U.S. PATENT DOCUMENTS

| | | | |
|---|---|---|---|
| 940,804 | 11/1909 | Hanson | 108/145 |
| 2,587,010 | 2/1952 | Thompson | 108/113 |
| 2,624,535 | 1/1953 | Boilhoefer | 108/145 X |
| 3,152,833 | 10/1964 | Creveling et al. | 108/144 X |
| 4,437,411 | 3/1984 | Maxwell . | |
| 4,502,394 | 3/1985 | Veyhl | 108/146 X |
| 4,553,872 | 11/1985 | Chandra et al. | 248/231.7 X |

FOREIGN PATENT DOCUMENTS

| | | | |
|---|---|---|---|
| 193101 | 1/1957 | Austria | 108/145 |
| 669637 | 12/1965 | Belgium | 108/113 |
| 1308512 | 9/1962 | France | 108/145 |
| 117292 | 9/1946 | Sweden | 108/145 |

*Primary Examiner*—Peter A. Aschenbrenner
*Attorney, Agent, or Firm*—Emrich & Dithmar

[57] ABSTRACT

A multi-level table for student activity use, such as in science or art labs, includes a top which may be adjusted relative to a base in either a raised or a lowered position. In either position, the table top is rigidly secured to the base for stability and the adjustment between positions is accomplished without removing the top from the base. Folding seats may be folded into a very tin profile for storage beneath the table top when not in use. A novel upright support is also disclosed which may be removably mounted onto the table top for use in supporting equipment used in laboratory work.

4 Claims, 3 Drawing Sheets

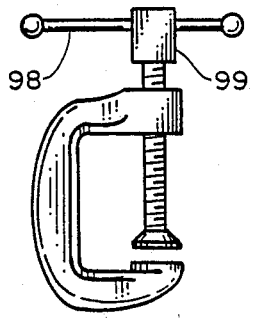
FIG. 3
PRIOR ART
FIG. 5
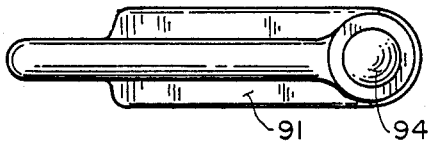
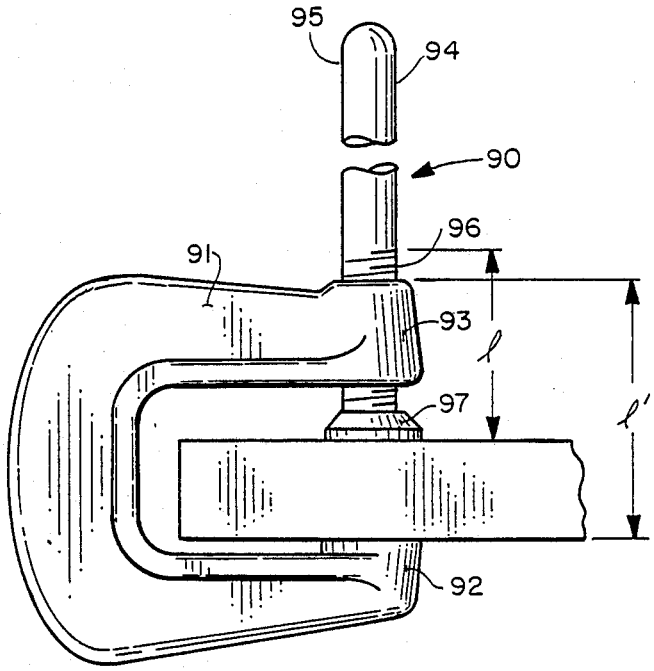
FIG. 4
FIG. 6
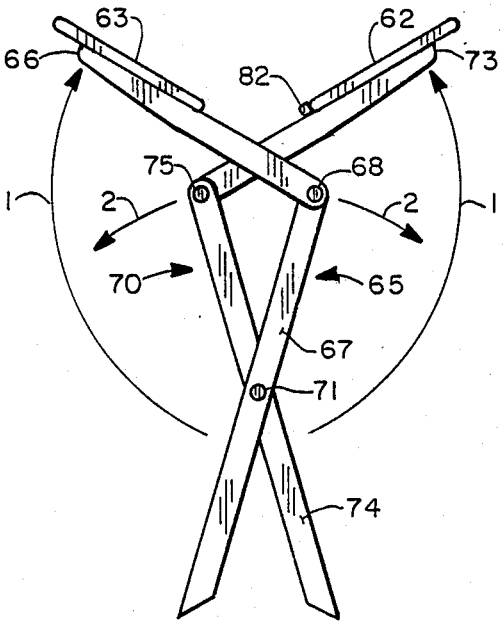
FIG. 7
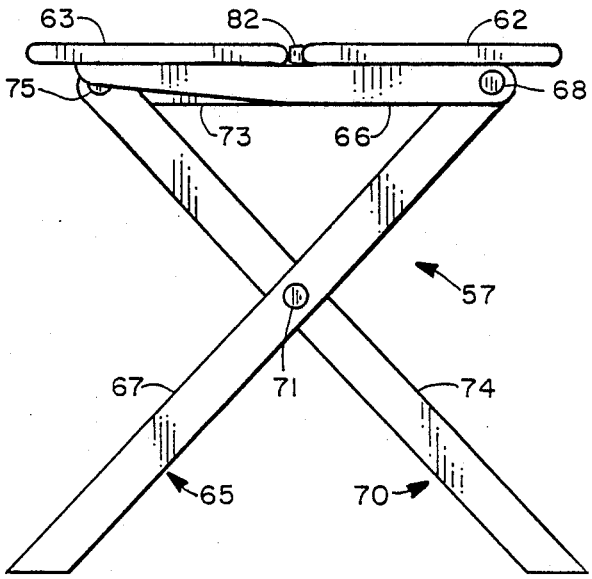

BILEVEL STUDENT ACTIVITY TABLE

BACKGROUND AND FIELD OF THE INVENTION

The present invention relates to tables; and, more particularly, it relates to a table which is designed so that the top may be adjusted to different elevations relative to a base which rests on the floor. The table is particularly useful as a student activity table, especially in science or art labs. For example, the top may be placed in the lower position for reading or other work done while seated which requires a work surface, or it may be raised for lab work done while the student is standing.

A bilevel, multi-purpose student table is disclosed in U.S. Pat. No. 4,437,411. In the table disclosed in said patent, the table top is adjusted to a higher position by removing the table top from the base and rotating two spaced support members to vertical positions. The table top was then placed on top of the upright support members and manually latched to it, requiring that a student at each end manually slide a latch member beneath the table top into engagement with the raised support members. Although this table is stable when properly used, it may be somewhat difficult for younger children to adjust the top to different use positions.

SUMMARY OF THE INVENTION

A principal purpose of the present invention is to provide a bilevel student activity table which is quickly, easily and reliably adjusted either to the raised or the lowered position and which is stable in either position without requiring a special latching mechanism or a manual latching step by the student. Because of the various activities in which such a student activity table is used, it is very important that when the table top is raised to the elevated position, that it be reliably secured to the base so that it is stable both to support substantial weight if necessary and to withstand a lateral force such as might occur if a student inadvertently bumped into the side of the table top.

The present invention provides such a bilevel student activity table wherein the table top may be readily adjusted between a lowered and a raised position and wherein the table top is secured to the base in either position, by providing first and second pivoting supports in the form of wing panels which are pivotally mounted to the base beneath the table top and are rotatable between a lowered and a raised position. In the raised position, the pivoting supports preferrably are not vertical, as in the table described in the above-identified patent. Rather, they are inclined upwardly and inwardly toward each other, and they are directly connected to the table top to provide greater stability and increased load-carrying capacity.

The distal ends of the pivoting uprights are provided with rollers or slide pins which are received in corresponding tracks formed by brackets beneath the table top which limit the motion of the slide pins as the pivoting supports are rotated. When the table top is in the lowered position, the slide pins are at the inboard limits of the tracks at opposite ends of the table top and secure the top to prevent lateral movement of the top relative to the base. When the top is raised to the elevated position, the pivoting supports are slanted inwardly and upwardly, and they are latched by means of a spring slat secured to the base with the slide pins at the outboard ends of the tracks, thereby limiting endwise movement of the top relative to the base in the raised position.

The legs of the table are spaced inwardly of the ends to provide space for storing four student seats which may be folded to a relatively thin profile for storage without protruding beyond the edges of the table top when they are stored beneath it.

The base of the table is in the form of an opentop box supported by the table leg assemblies; and when the table top is in the lowered position it is spaced above the base sufficient to prevent pinched fingers or hands and to provide storage space for equipment. Such equipment may include supports having a clamp base which may be secured to the table top when it is removed from the storage space beneath the top. An upright rod is received in the base and has a handleless, partially-threaded clamp bolt which limits the amount of torque that can be used to clamp the rod to the table top to prevent damage, and which prevents the equipment support from being used on tops that are too thin to support it.

Other features and advantages of the present invention will be apparent to persons skilled in the art from the following detailed description of a preferred embodiment accompanied by the attached drawing wherein identical reference numerals will refer to like parts in the various views.

BRIEF DESCRIPTION OF THE DRAWING

FIG. 3 is a side view of the prior art clamping device;

FIGS. 4 and 5 are respectively side and top views of an equipment support device which may be attached to the table top of FIG. 1; and FIGS. 6 and 7 are side views of a seat shown respectively being set up for use and in the use position, and folded to a thin profile for storing beneath the table of FIG. 1.

DETAILED DESCRIPTION OF THE PREFERRED EMBODIMENT

Figure 1:
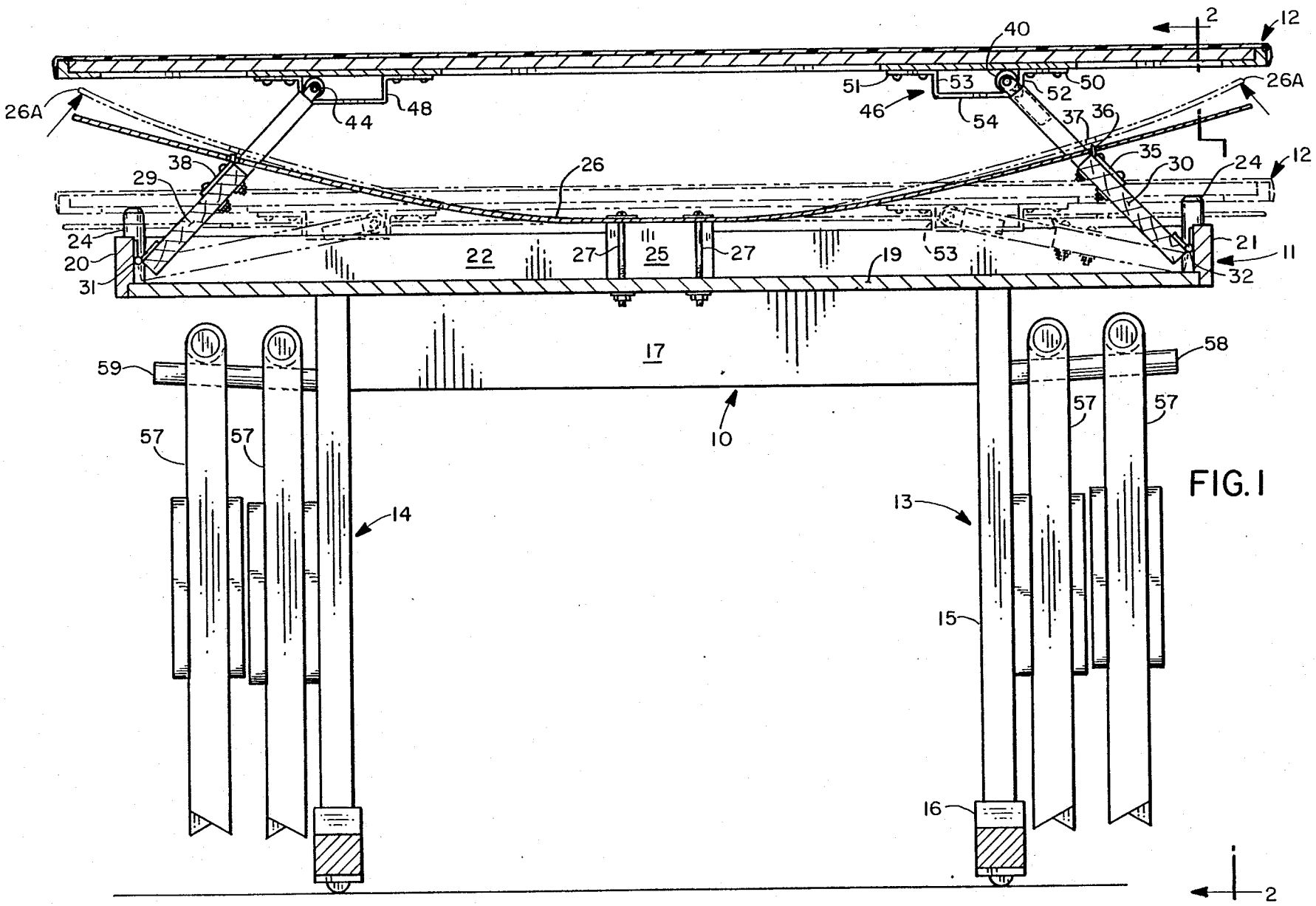
FIG. 1 is a side elevational view of a student activity table constructed according to the present invention, partly in cross-section, with the table top shown in a raised position in solid line and a lowered position in chain line.
Figure 2:
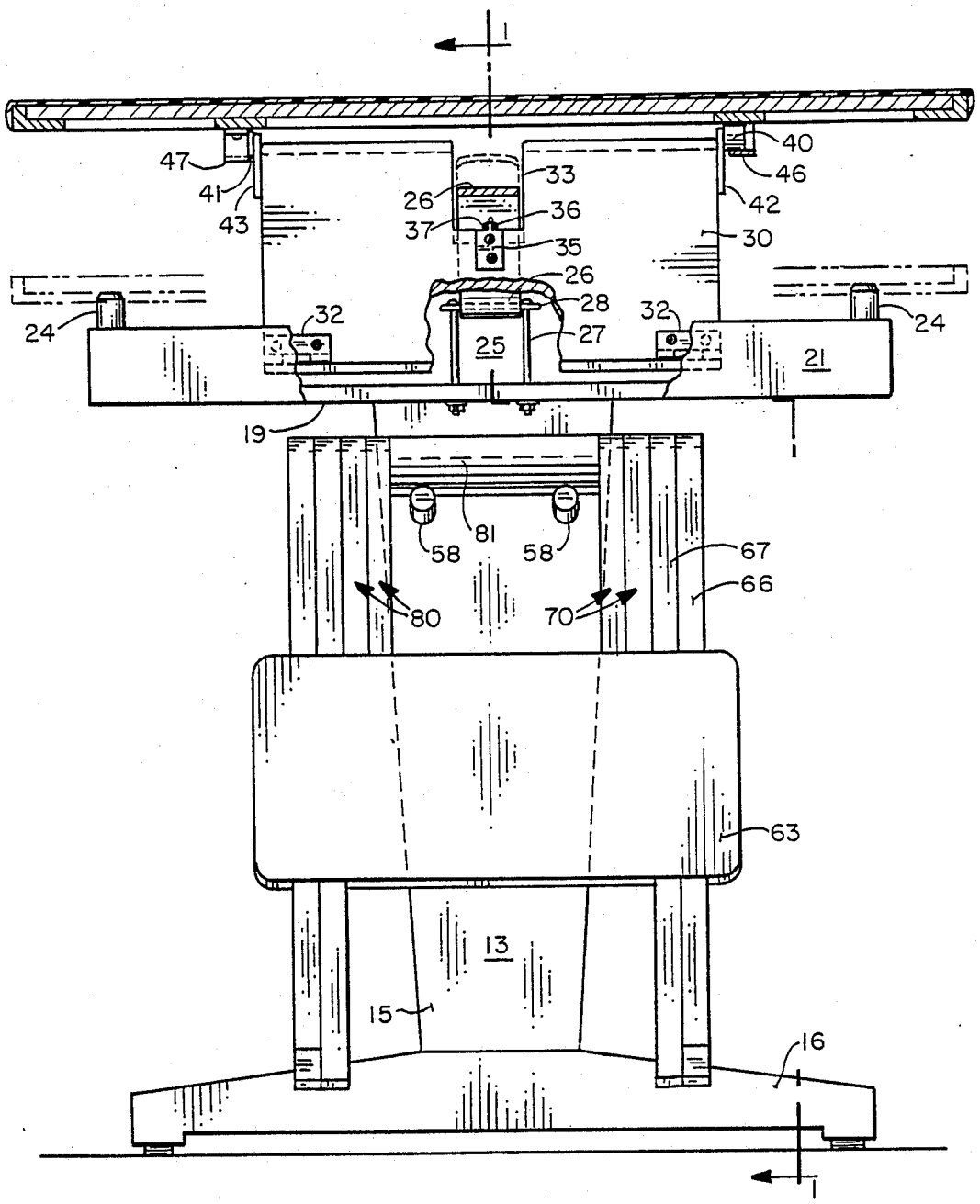
FIG. 2 is an end view taken from the right side of the table as seen in FIG. 1 with the top shown in cross-section through the sight line 2—2 in FIG. 1.

Referring first to FIGS. 1 and 2, a student activity table generally designated 10 includes a base generally designated 11 which supports a table top 12 and is, in turn, supported by first and second leg assemblies 13, 14. Each of the leg assemblies is similar in structure, and only one need be described further for a full understanding of the invention. As best seen in FIG. 2, the leg assembly 13 includes a stanchion support 15 and a foot 16 which may, if desired, be provided with conventional levelers or glides. A stretcher member 17 extends between the leg assemblies 13, 14 to provide a bracing.

The brace 11 is in the form of a generally open-top box having a bottom 19, first and second end rails 20, 21, and two side rails, one of which is seen in FIG. 1 and designated 22. The bottom 19 of the base 11 is connected to the leg assemblies 13, 14 and to the top of the stretcher 17 to form a rigid support structure for the table top 12. The base 11 includes four support dowels 24, one support dowel being located in each corner of the base.

An anchor block 25 is located at the center of the base 11 and is mounted to the upper surface of the bottom 19. An elongated spring slat 26 is located above the anchor block 25 and extends to either side of it. The spring slat 26 may be in the form of an elongated slat made of a springy wood material, or it may be metal having the necessary spring characteristic. In either case, the spring slat 26 and anchor block 25 are rigidly secured to the bottom 19 of the table base by means of threaded fasteners 27 and anchor plates 28.

First and second pivoting support members 29, 30 are connected by hinges to the inner surfaces of the end rails 20, 21. As seen in FIG. 2, there are a pair of hinges 32 connecting the pivoting support 30 to rail 21. Similarly a pair of hinges, one of which is seen at 31 in FIG. 1, mount the pivoting support 29 to end rail 20.

Turning now to FIG. 2, the pivoting support 30 is seen to be generally rectangular in shape; and it defines a slot 33 for receiving and guiding one end of the spring slat 26. Adjacent the bottom of the slot 33, there is secured a latch plate 35, the upper portion of which is formed into a latch pin 36. Pin 36 is received in an aperture 37 in the spring slat 26 when the table top is raised, as will be discussed further below. A similar latch plate 38 is attached to the pivoting support 29 on the other side of the table. Latch plate 38 similarly provides a latch pin adapted to couple to an aperture in the spring slat 26 when the table top is raised without further manual action on the part of the student raising the top.

Referring again to FIG. 2, first and second slide members 40, 41 are mounted by means of plates 42, 43 to the outboard edges of the pivoting support 30. Preferably, the slide members 40, 41 may be pins, but that may also be rollers. The slide pins are mounted, as by screws threaded in their associated plates, so that the pins can be removed if it is desired to remove the table top. Similar pins are provided at the outboard edges of pivoting support 29, one such pin being seen in FIG. 1 and designated 44.

The slide pins 40, 41 are received in guides mounted to the bottom surface of the table top 12. The guides form tracks of predetermined length for pins 40, 41. The tracks are designated 46, 47 respoectively in FIG. 2; and the track for roller 44 is seen at 48 in FIG. 1. As best seen in FIG. 1, each of the four tracks is a metal bracket in similar form so that only the track 46 need be described in further detail. The track 46 includes first and second flanges 50, 51 for mounting to the table top; and at its center, it is formed into depending portions 52 and 53 which define the ends of the track and are joined by a horizontal portion 54 spaced beneath the table top sufficient to receive and guide the associated slide pin 40. Thus, the structure just described provides a pin and track means which connects the table top to the pivoting supports and raises those supports when the table top is lifted. This structure also guides and limits the motion of the pivoting supports in both the raised and lowered positions, as will be further described below.

The table top 12 is seen in the lowered position in chain line in FIG. 1 wherein the bottom surface of the table top rests on the support dowels 24. In this position, the pivoting supports 29, 30 are lowered, through not horizontal (FIG. 1), and the slide pins are adjacent the innermost ends of their associated tracks. For example, the slide pin 40 is adjacent the depending portion 53 of track 46 as seen in chain line in FIG. 1. This stabilizes the table top and prevents it from moving end-wise (i.e., laterally in FIG. 1). The table top is stabilized in the transverse direction, as can be seen by referring to FIG. 2, in both the raised and the lowered position because any force tending to move it to the side in FIG. 2 is resisted by the proximity of the pivoting supports to the metal guides.

When it is desired to raise the table top as seen in solid line in FIG. 1, two students stand, one at either end of the table, and each student places one foot on top of the table foot 16. The students then lift the table top together and, without further manipulation by the students, the pivoting uprights 29, 30 rotate upwardly and their associated slide pins withdraw to the outboard reaches of the tracks provided by the guides mounted beneath the table top.

When the table top is in the raised position, the latch pins are received in the apertures of the slat spring so that the pivoting guides are held in the raised position; and the slide pins engage the outer depending portion of the associated guide. For example, as seen in FIG. 1, the slide pin 40 engages the depending portion of track 46 when the table top is raised. It will also be observed that the pivoting supports are inclined upwardly and inwardly in the raised position so that the pivot connections between pivoting supports and the base, together with those between the pivoting supports and the table top form a trapezoid to provide greater stability and resistance to racking than would otherwise be provided if the pivoting supports were vertical in the raised position. Thus, the table top is stabilized in the raised position because any attempt to move it laterally as seen in FIG. 1, for example to the left, would be resisted by the inclined pivoting support 30, track 46 and slide pin 40, as well as the latch pin 36 which holds the pivoting support in the raised position.

When it is desired to lower the table top, the exposed ends of the spring slat are moved upwardly in the direction of the arrows to the position shown in chain line at 26A in FIG. 1, thereby displacing the apertures above the latch pins, and permitting the table top to be lowered to rest on the support dowels 24, as seen in chain line in both FIGS. 1 and 2.

When the table top is placed in the lowered position, the pivoting supports 29, 30 are rotated downwardly and the slide pins 40, 44 are moved inwardly of their respective tracks until they engage the inboard ends of the tracks, as indicated by the depending portion 53 for the track 46. The spring slat 26 continues to urge the pivoting supports downwardly even in the lowered position for stability; and the resistance of the spring slat must be overcome before the table top can be raised. That is why it is helpful to have the students place one foot over the foot of the table to hold the base in place when lifting the top.

The top of the table is provided with Formica or similar material which is resistant to scratching and yet which may be imprinted with grids, scales or math tables depending upon the use for which it is intended.

As seen in FIG. 1, the ends of the base 11 of the table overhang the legs 13, 14, thereby providing room for the storage of four folding seats, such as those designated 57 in FIGS. 1 and 2. The seats are mounted on two pairs of pegs designated 58 and 59 respectively and mounted in the outer surfaces of the leg assemblies 13, 14 respectively. The pegs may be inclined upwardly and outwardly to bias the chairs toward the leg assemblies in securing them.

Turning now to FIG. 6, the seats 57 preferably are of the construction shown. The seat rest panel comprises two flat panel sections designated 62 and 63 respectively. Each panel section has connected at each side a pair of articulated links or leg sections, the upper link forming a horizontal support and the lower link forming a leg. Thus, as seen in FIG. 6, the seat panel 63 is attached to an articulated leg section generally designated 65 and having an upper member 66 and a leg portion 67 which are pivotally connected at 68. A corresponding articulated leg section is connected to the other side of the seat panel 63.

The other seat panel 62 is similarly mounted to a pair of articulated leg sections, one of which is designated 70 in FIG. 6, and a similar articulated leg section is connected to the other side of the seat panel 62 but is hidden by the articulated leg section 70 which is seen. The articulated leg sections 65, 70 are pivotally connected at 71, and the two leg sections not seen are similarly pivotally connected. The leg section 70 thus includes a horizontal member 73 to which the seat panel 62 is connected, and leg member 74 which are joined by a pivot connection 75. The pivot connections of the leg sections having the inner positions, namely, the articulated leg 70 and its corresponding inner leg section 80 as seen in FIG. 2 are joined at their pivots by a stretcher 81 which is used not only to strengthen the seats in use but also to rest them on the support dowels 58. To assemble the seat for use from the folded-flat position, the seat panels 62, 63 are raised upwardly and then the legs 67, 74 are opened as seen in FIG. 6, so that the seat panels 62, 63 may then rest on the horizontal members 66, 73 of the complementary articulated leg section until the two seat panels are drawn together as seen in FIG. 7. One of the seat panels (in this case seat panel 62) has connected to it a pair of resilient bumpers or spacers, one of which is seen in FIG. 7 and designated by reference numeral 82 so that a person assembling the seats cannot get his or her finger caught between the seat panels since they are drawn together tightly. The seats fold flat as seen in FIG. 1 and may be carried by the stretcher 81.

Another feature of the present invention which enables devices to be connected to the table top is an upright equipment support generally designated 90 in FIGS. 4 and 5. It includes a C-shaped portion 91 which has a base 92 and an internally threaded boss 93 for receiving a partially threaded upright or rod generally designated 94. The upper portion of the rod is rounded as at 95 and not threaded. The lower portion of the rod 94 is threaded as at 96, but the length of the thread combined with the length of a bearing member 97, which is designated by the arrow "1" in FIG. 4, is less than the length 1' extending from the base 92 to the top of the boss 93. As the upright 94 is threaded downwardly, when the screw thread 96 ends, the upright can no longer be lowered, and the abutment member portion 97 is spaced from the base 92 of the C-shaped portion 91. This minimum spacing is set to be equal to the minimum thickness of table top which is considered safe for the application, and it is an overall safety feature which is desirable particularly when the table is used as a student activity table. In other words, the upright 94 cannot be secured to a table top unless it has a minimum thickness, such as that shown in FIG. 4. Moreover, a student cannot exert great leverage on the upright in securing the upright support to a table top, such as is possible by a conventional prior art C-clamp as seen in FIG. 3 wherein a lever 98 is mounted by means of a connector 99 to a fully threaded shank.

Having thus disclosed in detail preferred embodiments of the inventions, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the claims.

We claim:

1. A table comprising: a base; support means for supporting said base on a floor; a table top above said base; first and second pivoting supports mounted to said base for pivotal movement between a lowered position in which said table top is supported by said base, and a raised position in which said table top is supported on said pivoting supports; spring slat means fixed to said base for biasing said pivoting supports toward said lowered position and engageable with sid supports in the raised position for releasably latching the same in the raised position; first and second sliding track means respectively interconnecting the distal ends of said pivoting supports with said table top each track means comprising a bracket mounted to the underside of said table top for defining a track of a length determined by the travel of its associated pivoting support between the raised and lowered positions; and a slide member on each pivoting support received in an associated track, whereby when the table top is lifted relative to said base, said slide members slide within their associated tracks and rotate their associated pivoting supports to the raised position such that each of said slide members engages one end of its associated track when said table top is in the raised position and engages the other end of said associated track when said table top is in the lowered position, whereby said tracks alone limit the motion of said slide members; and characterized in that when said pivoting supports are in the raised position, they are inclined upwardly and inwardly relative to said base, thereby to form a stable trapezoidal shape with said base and said table top, and said pivoting supports are latched in said raised position and the associated slide members are at the outboard limits of their associated tracks for stabilizing said table top against end-wise movement relative to said base in said raised and lowered positions.

2. The apparatus of claim 1 wherein said table includes a base having a bottom and four rails connected to the edges of said bottom and forming an open-top box beneath said top; and first and second leg assemblies supporting said base; said leg assemblies being located inwardly of opposing edges of said base; support means connected to said leg means and extending outwardly thereof beneath said base for supporting a folded seat; and at least one seat adapted to fold flat and to be supported by said support means beneath said base and stored within a vertical extension of the outermost edge of said table base.

3. The apparatus of claim 1 wherein said seat comprises first and second seat panels; first and second sets of articulated leg sections connected to each of said seat panels and extending beneath the other seat panel in the assembled condition; and means for pivotally connected together associated ones of said first and second sets of articulated leg sections at locations midway of the leg portions thereof; whereby all of said leg sections may fold vertically with said seat panels extending on opposite sides of the folded leg sections; and cushion means on the inboard edge of one of said panels for abutting the other panel in the assembled position to space said first and second panels in the assembled position.

4. The apparatus of claim 1 wherein said box-like base has a depth sufficient to receive an upright equipment support device, and further including an upright device comprising a C-shaped member having a base and an opposing threaded boss; and a rod threadedly received in said boss; said rod having a smooth, handleless upper portion and being threaded a predetermined length such that said rod in cooperation with its C-shaped member cannot be clamped or assembled to a table top of less than a predetermined thickness.

* * * * *